US007125304B2

(12) United States Patent
Tsuji et al.

(10) Patent No.: US 7,125,304 B2
(45) Date of Patent: Oct. 24, 2006

(54) METHOD OF MANUFACTURING PLASMA DISPLAY PANEL AND FIRING APPARATUS

(75) Inventors: Hiroyasu Tsuji, Osaka (JP); Makoto Morita, Hyogo (JP); Masanori Suzuki, Osaka (JP)

(73) Assignee: Matsushita Electric Industrial Co., Ltd, Osaka (JP)

( * ) Notice: Subject to any disclaimer, the term of this patent is extended or adjusted under 35 U.S.C. 154(b) by 330 days.

(21) Appl. No.: 10/486,188

(22) PCT Filed: Feb. 6, 2003

(86) PCT No.: PCT/JP03/06917

§ 371 (c)(1),
(2), (4) Date: Feb. 9, 2004

(87) PCT Pub. No.: WO03/102995

PCT Pub. Date: Dec. 11, 2003

(65) Prior Publication Data

US 2004/0180600 A1 Sep. 16, 2004

(30) Foreign Application Priority Data

Jun. 3, 2002 (JP) ..... 2002-161212

(51) Int. Cl.
*H01J 9/00* (2006.01)

(52) U.S. Cl. ..... 445/24

(58) Field of Classification Search ..... 445/23–25
See application file for complete search history.

(56) References Cited

FOREIGN PATENT DOCUMENTS

| | | |
|---|---|---|
| JP | 10-302635 | 11/1998 |
| JP | 2000-208053 | 7/2000 |
| JP | 2001-2440 | 1/2001 |
| JP | 2001-222952 | 8/2001 |

*Primary Examiner*—Joseph Williams
(74) *Attorney, Agent, or Firm*—Wenderoth, Lind & Ponack, L.L.P.

(57) ABSTRACT

A transition section for relieving the temperature difference between a front and a back of a substrate is provided before a temperature section at which constituent elements are fired. As a result, a method of manufacturing a plasma display panel and a firing apparatus, where the temperature difference between the front and the back of the substrate in a substrate-moving direction is prevented and the constituent elements are fired well, can be provided.

4 Claims, 5 Drawing Sheets

METHOD OF MANUFACTURING PLASMA DISPLAY PANEL AND FIRING APPARATUS

TECHNICAL FIELD

The present invention relates to a method of manufacturing a plasma display panel (hereinafter referred to as a "PDP") which is known as a display apparatus characterized by its thinness, lightness and large display, and a firing apparatus for the PDP.

BACKGROUND ART

In a plasma display panel (hereinafter referred to as a "PDP"), ultraviolet rays are generated by discharging gas and exciting phosphor to emit light for a color display. The plasma display panels are classified into two driving systems, i.e., an AC type and a DC type, and classified into two electric discharge systems, i.e., a surface discharge type and an opposed discharge type. The surface discharge type PDP has a three electrode structure is becoming the mainstream in PDPs because of its high resolution, large screen and ease of manufacture. In the three-electrodes-surface-discharge-type PDP mentioned above, pairs of display electrodes, which are parallel to each other, are formed on one substrate. In addition, address electrodes, which cross over the display electrodes, barrier ribs and phosphor layers are disposed on the other substrate. Using this structure, the phosphor layer can be relatively formed thicker, so that the PDP is suitable for a color display using phosphor.

Compared with a liquid crystal panel, the PDP has the following features, namely, a fast motion display, a wide viewing angle, ease of manufacturing a large panel and high quality because of being a self luminous type. As a result, recently, the PDP has drawn attention among flat display panels and has various uses (e.g., a display apparatus at a place where many people gather or a display apparatus for enjoying a large screen image at a home).

A conventional method of manufacturing the PDP is described hereinafter. Constituent elements such as electrodes or a dielectric layer are successively formed on a front substrate and a rear substrate by using a thick film process in which a printing process, a drying process, a firing process and the like are repeated in order. Then the front substrate and the rear substrate are put together and sealed.

In the drying process and the firing process, for example, a plurality of rollers are positioned parallel with each other in a substrate-moving direction so as to form a conveyer. The substrate is dried or fired while it is conveyed by the conveyer. An apparatus mentioned above is called a roller-hearth-sequential-firing apparatus (hereinafter referred to as a "firing apparatus"). Temperature patterns of the firing apparatus are described hereinafter. The substrate is heated to a certain temperature of drying or firing, and kept at the certain temperature for a predetermined time, so that drying or firing is performed. After that, the substrate is cooled.

However, in the conventional manufacturing method discussed above, the substrate tends to become deformed or broken, particularly in a firing process in which the heat load against the substrate is great. When the substrate is conveyed in the firing apparatus, the temperature difference between a front and a back of the substrate is generated in the substrate-moving direction. After that, when the substrate is fired to the firing temperature in just the state it is, the temperature difference becomes greatest in the firing process. As a result, thermal stress is generated, so that the substrate is deformed or broken.

Even when the substrate is not deformed or broken, temperature distribution is generated at the substrate. Therefore, when constituent elements formed on the substrate are dried or fired, a constituent element on the front becomes different from that on the back of the substrate in thermal hysteresis, so that the quality of the constituent elements may be reduced.

When a substrate becomes larger for a large screen or the moving speed becomes faster for high throughput, the problems discussed above become more conspicuous.

The present invention is directed to solve the problems discussed above, and aims to provide a method of manufacturing a PDP, where the temperature difference between a front and a back of a substrate is not generated in a substrate-moving direction, and a firing apparatus used for manufacturing the PDP.

SUMMARY OF THE INVENTION

A method of manufacturing a plasma display panel (PDP) of the present invention is a method of heating a substrate while moving the substrate, and includes the following steps:

a heating step for heating the substrate to a first temperature T1(° C.) with a first temperature gradient, a transition step for heating the substrate from the first temperature T1 (° C.) with a second temperature gradient smaller than the first temperature gradient, and a temperature keeping step for keeping temperature for a predetermined period at a second temperature T2 (° C.) higher than the first temperature T1 (° C.).

By manufacturing the PDP using the temperature pattern discussed above, a front of the substrate does not differ greatly from a back of the substrate in a temperature of firing. Therefore, great thermal stress is not generated, and the substrate is not deformed or broken.

DETAILED DESCRIPTION OF THE PREFERRED EMBODIMENT

The exemplary embodiment of the present invention is demonstrated hereinafter with reference to the accompanying drawings.

Figure 1:
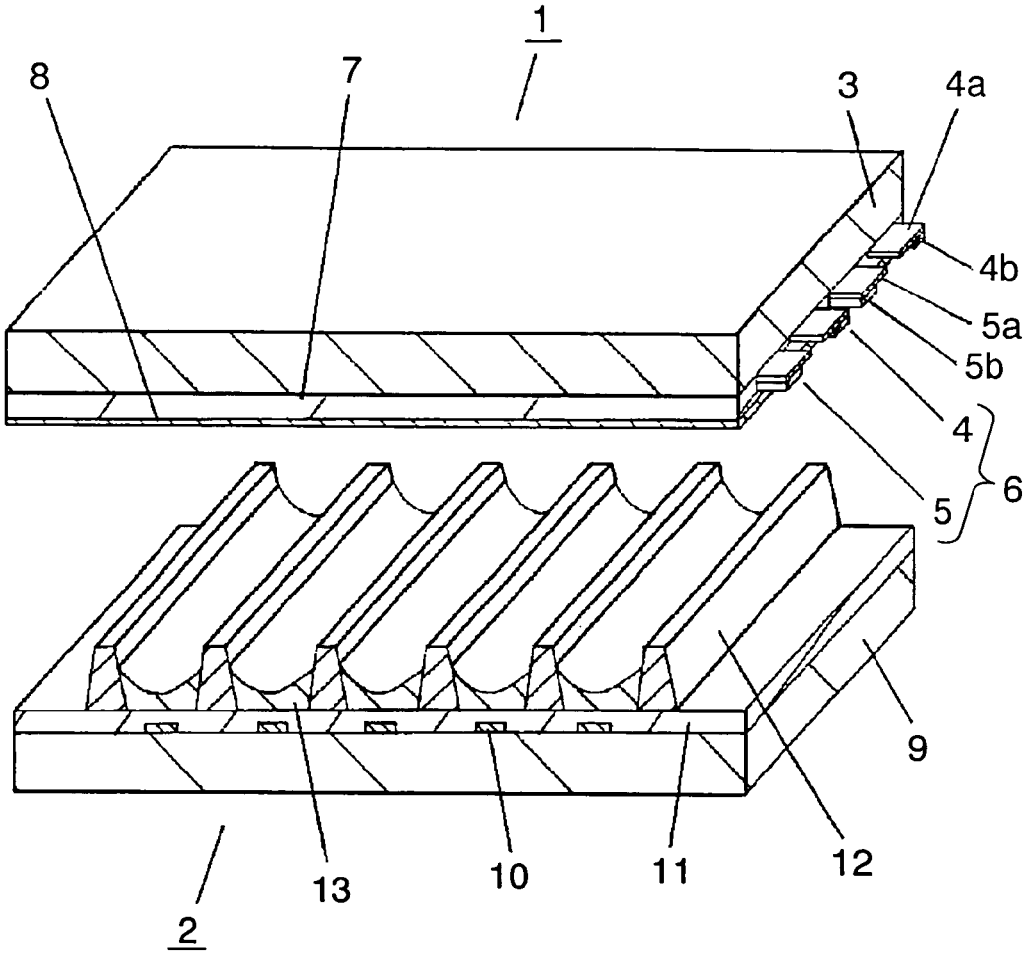
FIG. 1 is a perspective view showing a structure of a plasma display panel (PDP) manufactured by using a method of manufacturing the PDP in accordance with an exemplary embodiment of the present invention.

FIG. 1 is a perspective view showing a structure of a plasma display panel (hereinafter referred to as a "PDP") manufactured by using a method of manufacturing the PDP in accordance with an exemplary embodiment of the present invention.

The PDP is formed of a front substrate 1 and a rear substrate 2. The front substrate 1 is formed of a substrate 8, striped display electrodes 6, a dielectric layer 7 and a protective layer 8. The transparent and insulated substrate 3 is made of glass of sodium borosilicate base produced by a float method or the like. The display electrodes 6, each of which is formed of a pair of scan electrode 4 and sustain electrode 5, are disposed on substrate 3. The dielectric layer 7 covers the display electrodes 6, and the protective layer 8 made of MgO is formed on dielectric layer 7.

Each scan electrode 4 is formed of transparent electrode 4*a* and bus electrode 4*b*, which is formed so as to be connected to transparent electrode 4*a* and made of Ag or the like. Similarly, each sustain electrode 5 is formed of transparent electrode 5*a* and bus electrode 5*b*, which is formed so as to be connected to transparent electrode 5*a* and made of Ag or the like. Transparent electrode 4*a* and transparent electrode 5*a* are made of a transparent and insulated material such as ITO.

The rear substrate 2 is formed of substrate 9, address electrodes 10, dielectric layer 11, barrier ribs 12 and phosphor layers 13. The substrate 9 is disposed opposite to substrate 3. The address electrodes 10 are formed on substrate 9 so as to cross display electrodes 6 at right angles, and the dielectric layer 11 covers the address electrodes 10. Striped barrier ribs 12, which are parallel to address electrodes 10, are formed on dielectric layer 11 and between address electrodes 10. The phosphor layers 13 are placed between barrier ribs 12. In general, red, green and blue phosphor layers 13 are positioned in order for displaying a color image.

Front substrate 1 and rear substrate 2, discussed above, confront each other with a small discharge space in a manner that display electrodes 6 cross over address electrodes 10 at right angles. Peripheries of these substrates are sealed with a sealing member (not shown), and discharge gas containing a mixture of neon, xenon or the like is sealed in the discharge space, so that the plasma display panel is constructed.

The discharge space of the PDP is divided into a plurality of sections by barrier ribs 12, and display electrodes 6 cross over barrier ribs 12, so that a plurality of discharge cells, each of which becomes a unit emitting domain, are formed between barrier ribs 12. In this structure, display electrodes 6 cross over address electrodes 10 at right angles. A periodic voltage is applied on address electrodes 10 and display electrodes 6, thereby generating electric discharge. Then ultraviolet rays generated by the discharge irradiate phosphor layers 13, and change into visible light so that an image is displayed.

Figure 2:
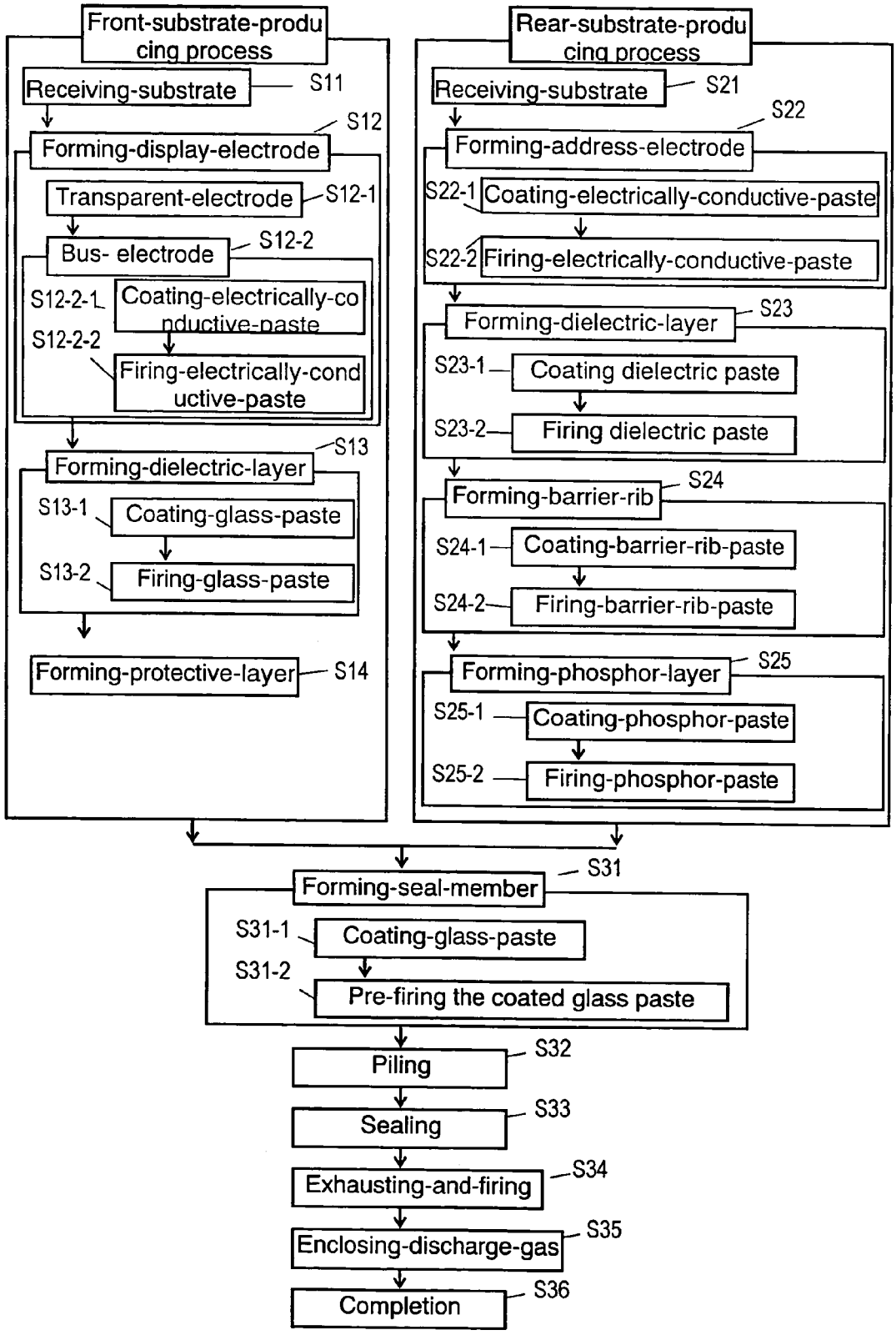
FIG. 2 is a flow chart showing processes of the method of manufacturing the PDP in accordance with the exemplary embodiment of the present invention.

The method of manufacturing the PDP, whose structure is discussed above, is demonstrated hereinafter with reference to FIG. 2. FIG. 2 is a flow chart showing processes of the method of manufacturing the PDP in accordance with the exemplary embodiment of the present invention.

First, a front-substrate-producing process for producing front substrate 1 is described hereinafter.

The front-substrate-producing process includes the following processes:

- receiving-substrate process S11 for receiving substrate 3, and
- forming-display-electrode process S12 for forming display electrodes 6 on substrate 3 after process S11.

Forming-display-electrode process S12 includes the following processes:

- forming-transparent-electrode process S12-1 for forming transparent electrodes 4*a* and 5*a*, and
- forming-bus-electrode process S12-2 for forming bus electrodes 4*b* and 5*b* after process S12-1.

Forming-bus-electrode process S12-2 includes the following processes:

- coating-electrically-conductive-paste process S12-2-1 for coating electrically conductive paste such as Ag by using a screen printing method or the like, and
- firing-electrically-conductive-taste process S12-2-2 for firing the coated electrically conductive paste after process S12-2-1.

In addition, the front-substrate-producing process includes forming-dielectric-layer process S13 for forming dielectric layer 7 so as to cover display electrodes 6 which is formed in forming-display-electrode process S12.

Forming-dielectric-layer process S13 includes the following processes:

- coating-glass-paste process S13-1 for coating paste including glass material of lead base, whose ratio is lead oxide (pbO) of 70 wt %, boron oxide ($B_2O_3$) of 15 wt % and silicon dioxide ($SiO_2$) of 15 wt % for example, by using a screen printing method or the like, and
- firing-glass-paste process S13-2 for firing the coated glass material after process S13-2.

Furthermore, the front-substrate-producing process includes forming-protective-layer process S14 for forming a protective layer 8 such as magnesium oxide (MgO) on a surface of dielectric layer 7 by using a vacuum deposition method or the like. The front substrate 1 is produced through these processes discussed above.

Second, a rear-substrate-producing process for producing rear substrate 2 is described hereinafter.

The rear-substrate-producing process includes the following processes:

- receiving-substrate process S21 for receiving substrate 9, and
- forming-address-electrode process S22 for forming address electrodes 10 on substrate 9 after process S21.

Forming-address-electrode process S22 includes the following processes:

- coating-electrically-conductive-paste process S22-1 for coating electrically conductive paste such as Ag by using a screen printing method or the like, and
- firing-electrically-conductive-paste process S22-2 for firing the coated electrically conductive paste after process S22-1.

In addition, the rear-substrate-producing process includes forming-dielectric-layer process S23 for forming dielectric layer 11 on address electrodes 10.

Forming-dielectric-layer process S23 includes the following processes:

- coating-dielectric-paste process S23.1 for coating dielectric paste including $TiO_2$ particles and dielectric glass particles by using a screen printing method or the like, and
- firing-dielectric-paste process S23-2 for firing the coated dielectric paste after process S23-1.

Furthermore, the rear-substrate-producing process includes forming-barrier-rib process S24 for forming barrier ribs 12 on dielectric layer 11 and between address electrodes 10.

Forming-barrier-rib process S24 includes the following processes:

coating-barrier-rib-pasts process S24-1 for coating barrier rib paste including glass particles by using a screen printing method or the like, and firing-barrier-rib-paste process S24-2 for firing the coated barrier rib paste after process S24-1.

Besides, the rear-substrate-producing process includes forming-phosphor-layer process S25 for forming phosphor layers 13 between barrier ribs 12.

Forming phosphor-layer process S25 includes the following processes:

coating-phosphor-paste process S25-1 for making and coating red, green and blue phosphor pastes between barrier ribs, and firing-phosphor-paste process S25-2 for firing the coated phosphor paste after process S25-1. Rear substrate 2 is produced through these processes discussed above.

Third, sealing between front substrate 1 and rear substrate 2, exhausting in a vacuum after sealing, and enclosing discharge gas are described hereinafter.

In forming-seal-member process S31, a seal member containing glass frit for sealing is formed on one side or both sides of front substrate 1 and rear substrate 2.

Forming-seal-member process S31 includes the following processes:

process S31-1 for coating glass paste for sealing, and pre-firing-glass-paste process S31-2 for pre-firing the coated glass paste for removing resin ingredients or the like therein after process S31-1.

Then, in piling process S32, front substrate 1 is piled on rear substrate 2 such that display electrodes 6 and address electrodes 10 confront and cross each other at right angles. After that, in sealing process S33, the piled substrates are heated and the seal member is softened, so that front substrate 1 and rear substrate 2 are sealed with each other.

In exhausting-and-firing process S34, sealed substrates 1 and 2 are fired while small discharge spaces formed by sealed substrates 1 and 2 are exhausted in a vacuum. After that, in enclosing-discharge-gas process S35, discharge gas is enclosed at a certain pressure, thus the PDP is completed (S36).

Figure 3:
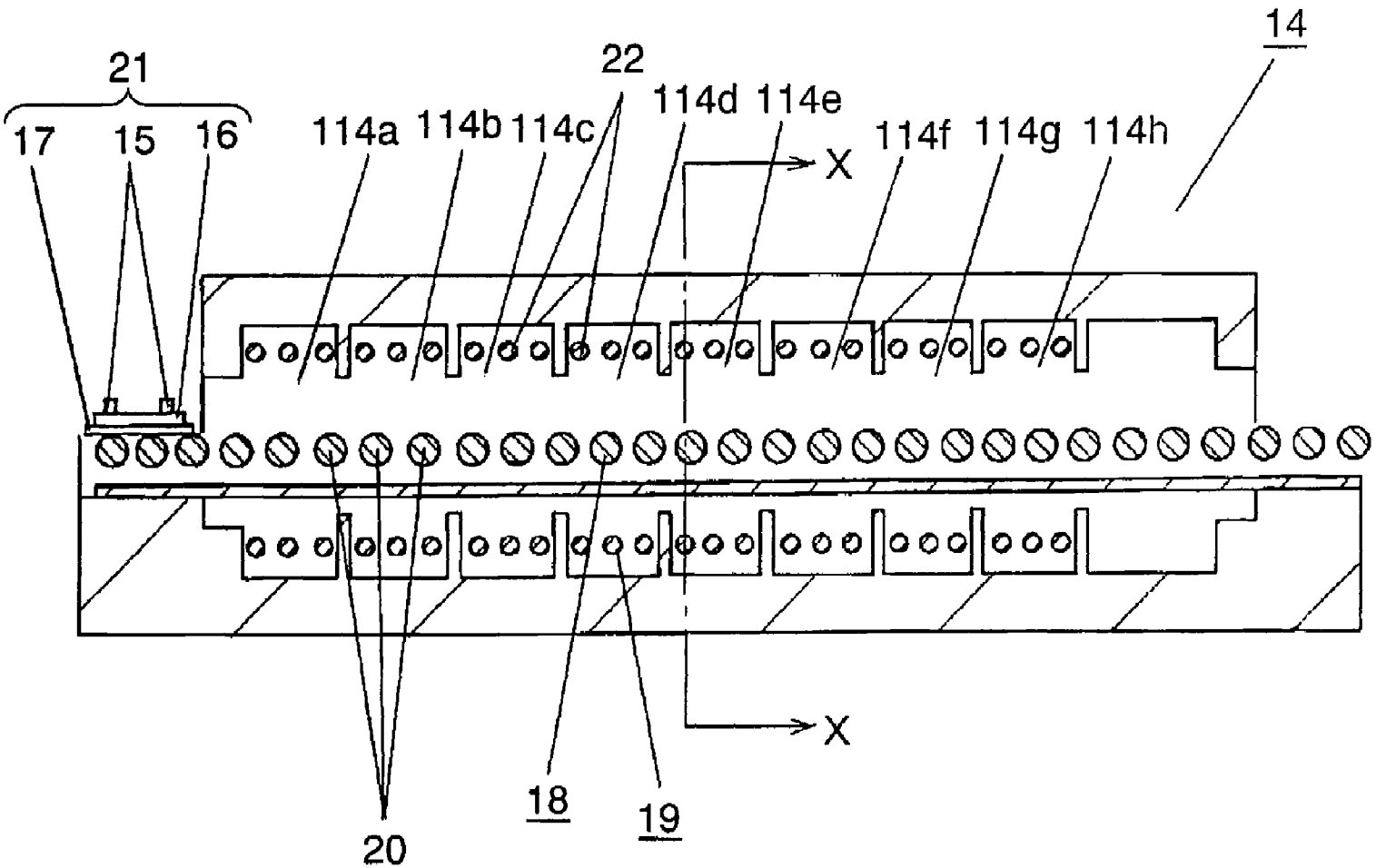
FIG. 3 is a sectional view showing a firing apparatus for the PDP in accordance with the exemplary embodiment of the present invention.
Figure 4:
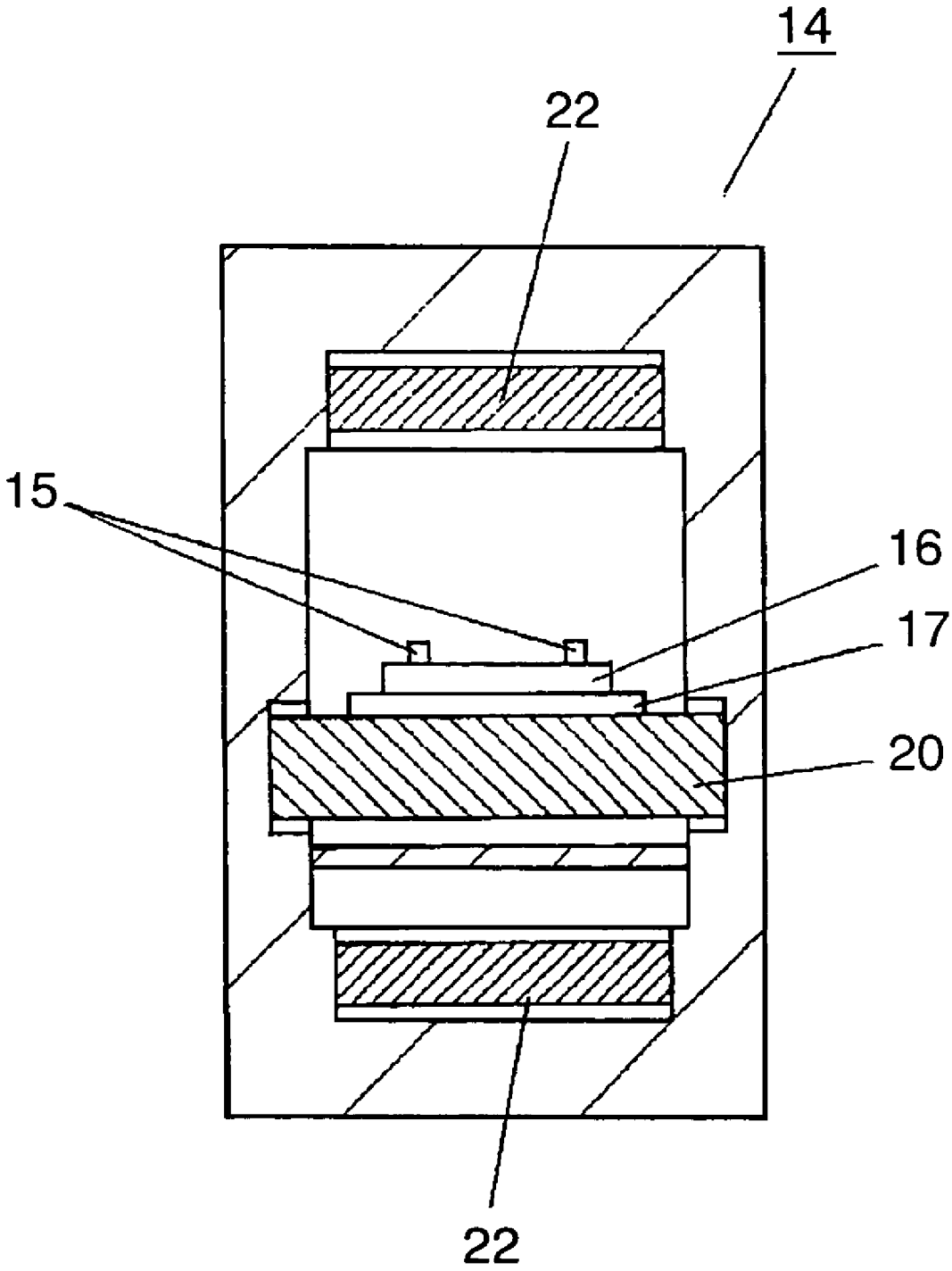
FIG. 4 is a sectional view of the firing apparatus of FIG. 3 taken along line X—X.

FIG. 3 is a sectional view showing a firing apparatus used for manufacturing the PDP in accordance with the exemplary embodiment of the present invention. FIG. 4 is a sectional view of the firing apparatus of FIG. 3 taken along line X—X. The firing apparatus of the present invention is demonstrated hereinafter with reference to FIGS. 3 and 4. In the manufacturing processes of the PDP, as shown in FIG. 2, firing processes are used in many processes for forming bus electrodes 4*b* and 5*b*, dielectric layer 7, address electrodes 10, dielectric layer 11, barrier ribs 12, phosphor layers 13 and the seal member (not shown) which are constituent elements 15 of the panel.

Firing apparatus 14 includes conveyer 18 for conveying substrate 16 where constituent elements 15 are formed, and firing unit 19 for firing substrate 16. Substrate 16 is either substrate 3 of front substrate 1 or substrate 9 of rear substrate 2 of the PDP.

Conveyer 18 is formed of a plurality of rollers 20 positioned in a substrate-moving direction. In conveying, for preventing substrate 16 from being injured by rollers 20, substrate 16 is placed on setter 17 and conveyed. Substrate 16, constituent elements 15 and setter 17, which are objects to be fired, are referred to as object 21 hereinafter.

Firing unit 19 is, for example, formed of a plurality of heaters 22 in firing apparatus 14. The inside of firing apparatus 14 is divided into units 114*a*–114*h* along the substrate-moving direction of object 21. Temperature conditions of heaters 22 can be individually controlled at the respective units, so that the object 21 can be fired with a predetermined temperature pattern by controlling the conveyance of the rollers 20 and the temperature conditions of the heaters 22.

Figure 5:
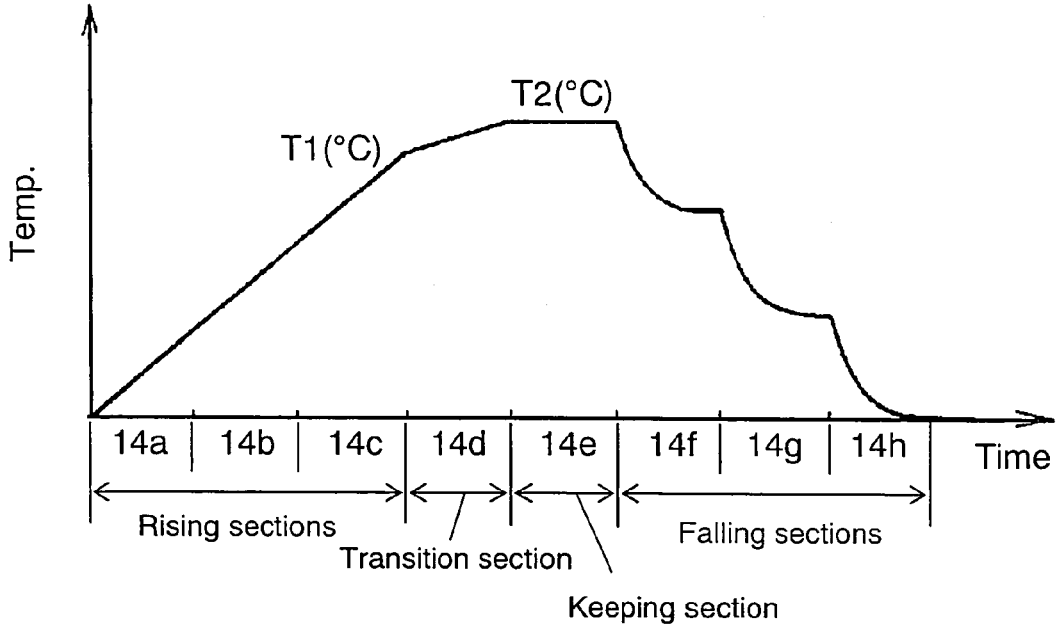
FIG. 5 is an example of temperature patterns for firing a substrate in the method of manufacturing the PDP and the firing apparatus for the PDP in accordance with the exemplary embodiment of the present invention.

Examples of temperature patterns of the firing apparatus are demonstrated hereinafter. FIG. 5 is the example of the temperature patterns in a firing process of the method of manufacturing the PDP in accordance with the exemplary embodiment of the present invention. Sections 14*a*–14*h* of a horizontal axis correspond to units 114*a*–114*h* of firing apparatus 14 shown in FIG. 3. In FIG. 5, sections 14*a*–14*c* are temperature rising sections formed by heating steps, section 14*d* is a transition section formed by a transition step, section 14*e* is a temperature keeping section formed by a temperature keeping step and sections 14*f*–14*h* are temperature falling sections formed by cooling steps.

In temperature rising sections 14*a*–14*c*, object 21 is heated to temperature T1 (° C.), which is lower than predetermined firing temperature T2 (° C.). Then, in the transition section, object 21 is heated from temperature T1 (° C.), which is lower than predetermined firing temperature T2 (° C.), with a second temperature gradient that is smaller than a first temperature gradient at the heating steps.

According to the present invention, the transition section is provided and the temperature gradient of the transition section becomes smaller. Therefore, even when the temperature difference between a fore (front) and a back of substrate 16 is generated in the substrate-moving direction in temperature rising sections 14*a*–14*c*, the temperature difference is relieved while object 21 is heated to predetermined firing temperature T2 (° C.). Before the temperature keeping step in the temperature keeping section, the temperature difference between the front and the back of substrate 16 of object 21 becomes smaller in the subtrate-moving direction. As a result, the substrate is not deformed or broken because the temperature difference between the front and the back of substrate 16 is not accelerated during firing. In addition, the quality of the PDP is not reduced because thermal hysteresis of the constituent elements 15 formed on substrate 16 are not significantly different from each other during firing.

Because the transition section relieves the temperature difference between the front and the back of substrate 16 generated in the substrate-moving direction in the temperature rising sections, at the heating steps in the temperature rising sections, the temperature difference between the front and the back of substrate 16 before the temperature keeping step in the temperature keeping section is not necessary to be limited. Therefore, a large temperature gradient can be performed in the temperature rising sections. As a result, throughput can be increased in the firing processes.

When first temperature T1 (° C) and second temperature T2 (° C.) have the following relation, relief of the temperature difference between the front and the back of substrate 16 in the transition section becomes advantageous.

$$0.9 \times T2 \leqq T1 < T2$$

In addition, from a viewpoint of relief of the temperature difference between the front and the back of substrate 16, intermittent conveying is preferable for conveying the substrate at the transition step in the transition section. In other words, the feed speed of each roller 20 may be performed so as to be variable, and the object may be kept for a predetermined period in a certain atmosphere at a predetermined temperature in the transition section and then conveyed to the temperature keeping section. Using this method, the temperature difference between the front and the back of substrate 16 can be smaller.

Figure 6:
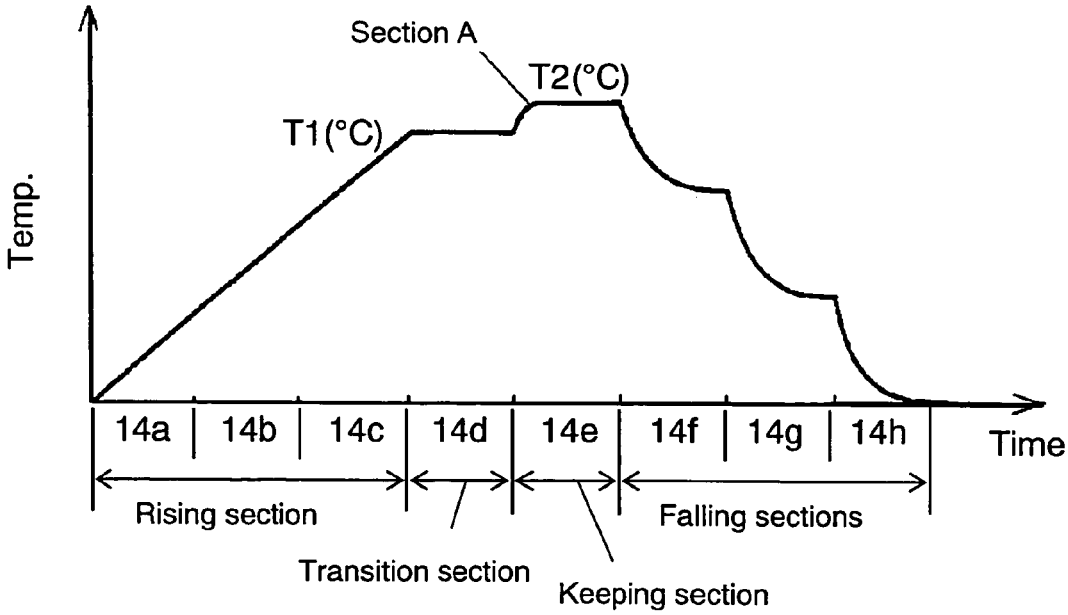
FIG. 6 is another example of the temperature patterns for firing the substrate in the method of manufacturing the PDP and the firing apparatus for the PDP in accordance with the exemplary embodiment of the present invention.

FIG. 6 is another example of the temperature patterns. A condition of heating in the transition section is controlled in a manner that a temperature gradient at transition section 14*d* becomes zero, namely, temperature at transition section 14*d* becomes constant. Using this method, relief of the temperature difference between the front and the back of substrate 16 becomes more effective. In this state, rapid temperature rising section "A" from transition section 14*d* to temperature keeping section 14*e* is generated. However, when first temperature T1 (° C) and second temperature T2 (° C) have the following relation, influence on substrate 16 can be eliminated.

$$0.9\times T2 \leqq T1 < T2$$

According to a method of manufacturing a plasma display panel and a firing apparatus of the present invention, a transition section for relieving the temperature difference between a front and a back of a substrate is provided before a temperature section at which constituent elements are fired. As a result, the temperature difference between the front and the back of the substrate in a substrate-moving direction is prevented, and the constituent elements are fired well.

The invention claimed is:

1. A method of manufacturing a plasma display panel (PDP) for heating a substrate while conveying the substrate, the method comprising:

a heating step for heating the substrate to a first temperature T1(° C) with a first temperature gradient;

a transition step for heating the substrate from the first temperature T1 (° C) with a second temperature gradient that is smaller than the first temperature gradient; and a temperature keeping step for keeping temperature for a predetermined period at a second temperature T2 (° C) higher than the first temperature T1 (° C.), and wherein the first temperature T1 (° C) and the second temperature T2 (° C) have the following relation 0.9×T2≦T1<T2, and a condition of heating is controlled in a such manner that the second temperature gradient at the transition step is zero.

2. The method of manufacturing the plasma display panel of claim 1, wherein the conveying of the substrate at the transition step is intermittent conveying.

3. A firing apparatus for a plasma display panel (PDP) comprising:

a conveyer for conveying a substrate;

a firing unit for firing the substrate while being conveyed by the conveyer, the firing unit including a plurality of heaters divided into a plurality of heating units arranged along the substrate-moving direction of the conveyer, wherein temperature conditions in each of the heating units can be individually controlled so that the substrate can be fired with a predetermined temperature pattern; and wherein the heating units are controllable so as to include:

a temperature rising section for heating the substrate to a first temperature T1(° C) with a first temperature gradient;

a transition section for heating the substrate from the first temperature T1 (° C) with a second temperature gradient that is smaller than the first temperature gradient; and a temperature keeping section for keeping temperature for a predetermined period at a second temperature T2 (° C) higher than the first temperature T1 (° C.), wherein the first temperature T1 (° C) and the second temperature T2 (° C) can be maintained so as to satisfy the relation 0.9×T2≦T1<T2, and a condition of heating can be controlled in such a manner that the second temperature gradient at the transition step is zero.

4. The firing apparatus for the PDP of claim 3, wherein the conveyor is operable to convey the substrate at the transition step in an intermittent conveying manner.

* * * * *

UNITED STATES PATENT AND TRADEMARK OFFICE

CERTIFICATE OF CORRECTION

PATENT NO. : 7,125,304 B2
APPLICATION NO. : 10/486188
DATED : October 24, 2006
INVENTOR(S) : Hiroyasu Tsuji et al.

It is certified that error appears in the above-identified patent and that said Letters Patent is hereby corrected as shown below:

ON TITLE PAGE,

In the title (54), please replace "METHOD OF MANUFACTURING PLASMA DISPLAY PANEL AND FIRING APPARATUS" with --FIRING APPARATUS FOR SUBSTRATE AND METHOD OF MANUFACTURING PLASMA DISPLAY PANEL USING THE SAME--.

On Title Page,

Under (22), PCT Filed, please replace "February 6, 2003" with --June 2, 2003--.

Signed and Sealed this

Second Day of January, 2007

JON W. DUDAS
*Director of the United States Patent and Trademark Office*